US007854081B2

(12) United States Patent
Flynn et al.

(10) Patent No.: US 7,854,081 B2
(45) Date of Patent: Dec. 21, 2010

(54) DISPLAY APPARATUS FOR FILE INDEX

(75) Inventors: Timothy J. Flynn, 8 Knoll La., Key Largo, FL (US) 33037; Thomas E. Flynn, Crystal Lake, IL (US); Patrick J. Flynn, Redlands, CA (US); Neal Hermanson, Elgin, IL (US); Phil Revell, Homer Glen, IL (US); Steve Solberg, Carpentersville, IL (US)

(73) Assignee: Timothy J. Flynn, Key Largo, FL (US)

( * ) Notice: Subject to any disclaimer, the term of this patent is extended or adjusted under 35 U.S.C. 154(b) by 167 days.

(21) Appl. No.: 12/218,034

(22) Filed: Jul. 9, 2008

(65) Prior Publication Data

US 2010/0007131 A1 Jan. 14, 2010

(51) Int. Cl.
*G09F 23/10* (2006.01)

(52) U.S. Cl. ..... 40/641; 229/102.5; 229/67.4

(58) Field of Classification Search ..... 40/641; 229/102.5, 67.4, 67.1, 67.3
See application file for complete search history.

(56) References Cited

U.S. PATENT DOCUMENTS 5,966,852 A * 10/1999 Drzewiecki ..... 40/360
6,138,900 A * 10/2000 Zeiler ..... 229/67.4
2003/0126779 A1 7/2003 Sato et al.
2004/0149603 A1 * 8/2004 Hodsdon ..... 206/312
2008/0078818 A1 4/2008 Botkin

FOREIGN PATENT DOCUMENTS

EP 08769128 A1 11/1998
KR 20-0260070 Y1 1/2002

OTHER PUBLICATIONS

"Avery+Labels," http://web.archive.org/web/20051219031220/http://www.allprosoftware.com/am/screens/Avery+Labels.jpg, Dec. 19, 2005.*
Co-pending U.S. Appl. No. 12/218,075, Titled: Label Assembly, filed Jul. 9, 2008.

* cited by examiner

*Primary Examiner*—Gary C Hoge
(74) *Attorney, Agent, or Firm*—Pauley Petersen & Erickson

(57) ABSTRACT

A display apparatus that can be positioned within a file cabinet, a file drawer, a hanging file and/or any other suitable file index system. A container is formed by the sheet material. The container has an edge panel forming at least one releasable tab. Each tab can be released or positioned away from an outer surface of the edge panel. A label sheet or label assembly has printable labels and at least one identification label. The identification label has or displays an identifier that corresponds to a particular design parameter of the label sheet. The identification label can be attached to the tab. The container can house one or more label sheets.

21 Claims, 4 Drawing Sheets

DISPLAY APPARATUS FOR FILE INDEX

BACKGROUND OF THE INVENTION

1. Field of the Invention

This invention relates to a container that can be used to store or house sheet material, such as label sheets, and also to display information for identifying materials housed within the container.

2. Discussion of Related Art

Files, such as hanging files, have index tabs for displaying information to identify contents within the file. For example, hanging files have index tabs that are positioned at an angle, for convenient viewing purposes.

Conventional label sheets contain multiple individual and removable labels. Conventional label sheets have borders surrounding the labels and offer labels in different sizes and shapes.

Many conventional label sheets have a face stock adhered to a base sheet. Conventional adhesives on label sheets adhere more to the face stock than to the base sheet, so that when a face stock label is removed from the base sheet, the layer of adhesive remains with or sticks to the face stock of the label. The face sheet and the adhesive can be used to removably attach or to permanently attach a label with respect to another surface.

SUMMARY OF THE INVENTION

According to the display apparatus and the label assembly of this invention, a container can be formed to house or store label sheets or label assemblies, such as within a compartment formed by the container. For example, label sheets of a particular size, style and/or other design parameter can be stored within the container.

An edge panel formed by the container can have at least one tab that can be released from the edge panel and displayed or positioned away from the edge panel. The tab can be positioned at a particular angle, depending upon a desired viewing arrangement of the tab and the corresponding file. For example, the container can be placed within a file drawer or within a hanging file, so that the tab is visible, such as in a manner similar to conventional index tabs of conventional hanging files. In some embodiments of this invention, the label sheet or label assembly housed within the container can have an identification label that is removable from the label sheet. The identification label can have an adhesive backing for adhering to the releasable tab formed by the edge panel of the container.

In some embodiments of this invention, the identification label has an identifier, such as printable text or handwritten text, on the surface of the printable label. In some embodiments of this invention, the identifier can correspond to any design parameter of the label assembly. For example, an alpha character and/or a numeric character can be printed or otherwise placed on the identification label.

With the label sheet and/or the display apparatus according to this invention, it is possible to display ordering information, such as a model number, a stock number, a design style, a label size and/or a label type on the identification label. Thus, when a particular label size or label sheet is required, the user can easily identify which containers house which label sheets or label assemblies. The identifier can also be used to reorder label sheets to replace empty or relatively low stock.

In some embodiments of this invention, the edge panel contains a plurality of tabs. The tabs can be positioned adjacent to each other or spaced apart from each other. Different tabs can be moved or released into different display positions. For example, to achieve a staggered arrangement for better visibility and easier reading, adjacently placed containers can have differently located or sequential tabs each moved into a display position.

In some embodiments of this invention, the tab can be released from the edge portion and then returned back to its normal position and held or locked into its original position by a structural element, such as a folding panel positioned within a slit or other opening. This particular feature can be used to use the releasable tab in one staggered position and then move the container to another area of the file and use a different releasable tab to maintain an overall staggered position or to provide better visibility.

In certain embodiments of this invention, at least a portion of a periphery of the releasable tab has a line of separation, such as a perforation, a microperforation or another suitable tearable line of separation.

The identification label can be positioned in a border area of the label sheet, so that the identification label does not occupy space that is otherwise available for a printable or otherwise usable label. Positioning the identification label within a border area also allows a mechanical printer or other conventional printer to move the label sheet through the printer by applying rollers to the border areas.

BRIEF DESCRIPTION OF THE DRAWINGS

This invention is explained in view of exemplary embodiments, making reference to the drawings, wherein.

DETAILED DESCRIPTION OF THE INVENTION

Figure 1:
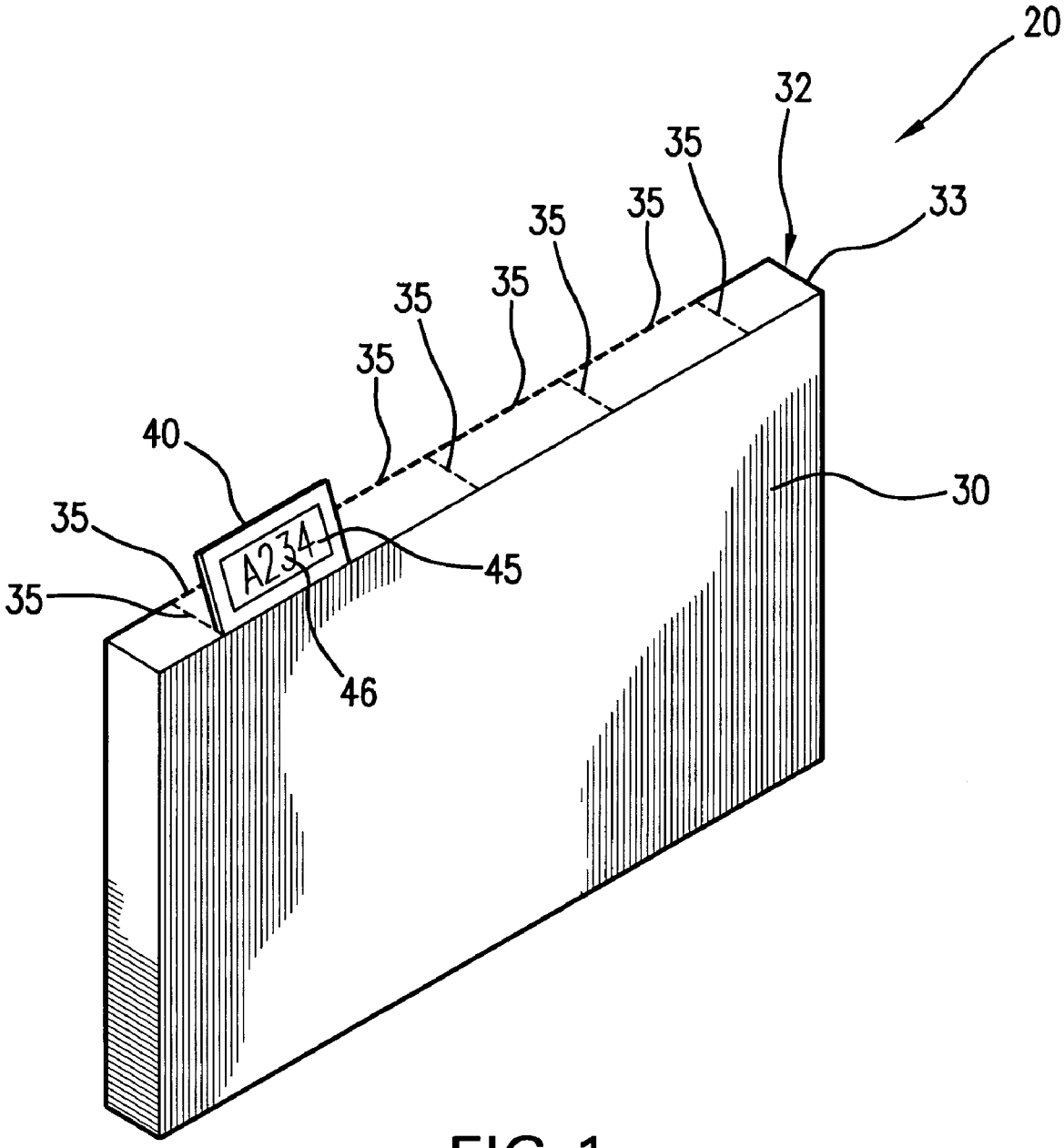
FIG. 1 is a front perspective view of one display apparatus having one tab released or moved into a display position, according to one embodiment of this invention.
Figure 2:
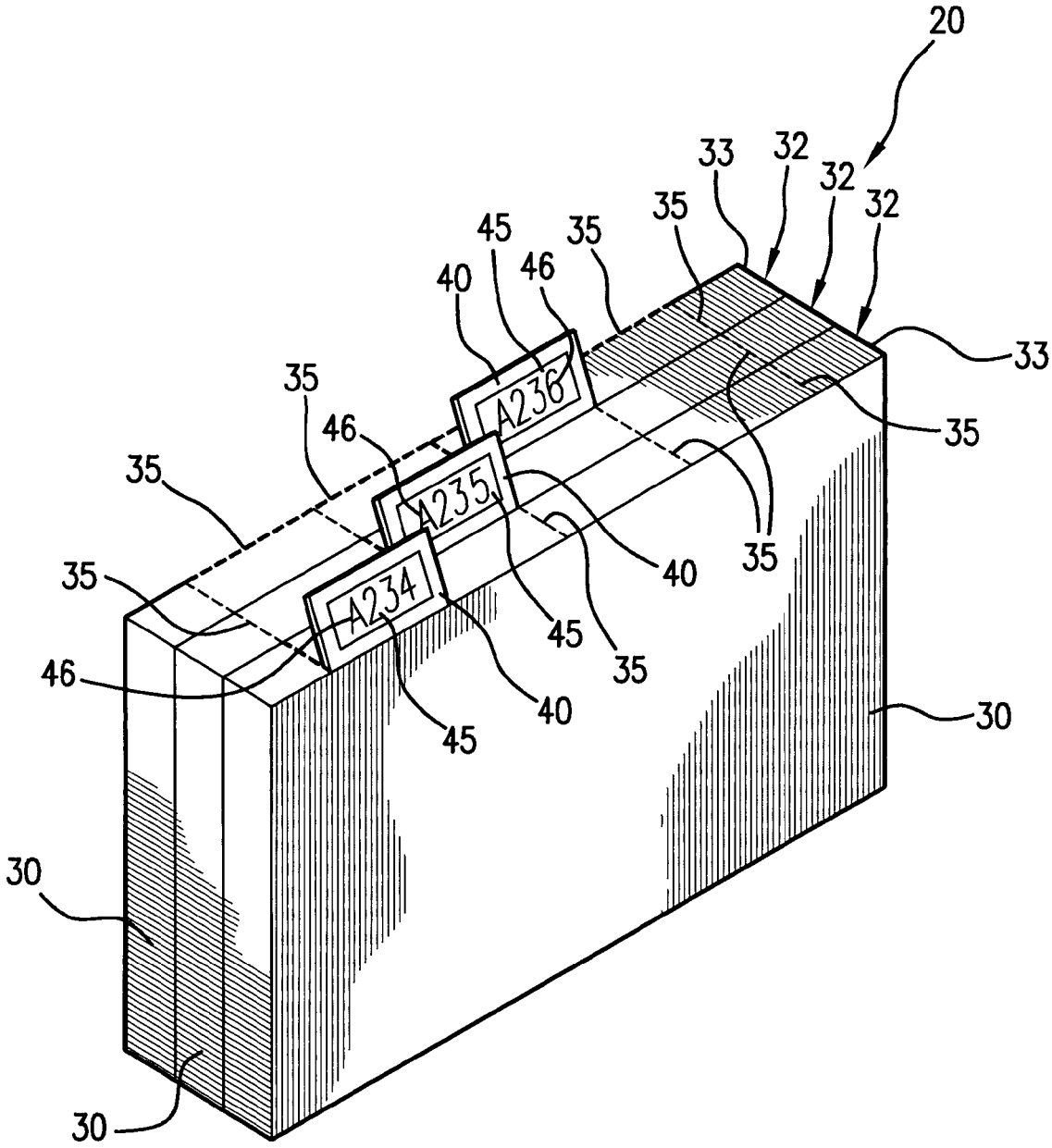
FIG. 2 is a perspective front view of three display apparatuses positioned adjacent to each other, with three tabs, one from each display apparatus, arranged in a staggered configuration, according to another embodiment of this invention.

FIG. 1 shows a perspective view of one display apparatus 20, according to one embodiment of this invention. FIG. 2 is a perspective view that shows the same container 30 of display apparatus 20 as shown in FIG. 1, vertically stacked in front of and grouped together with two other containers 30, according to this invention. As FIG. 2 shows, each container 30 can have a differently positioned tab 40 moved to a display position, so that the overall grouped appearance forms a staggered arrangement. With a staggered arrangement, each tab 40 has better visibility, for example when two or more containers 30 of display apparatuses 20 are positioned in a file drawer, a file cabinet or another similar file index. In other embodiments of this invention, tabs 40 do not form a staggered arrangement.

Figure 3:
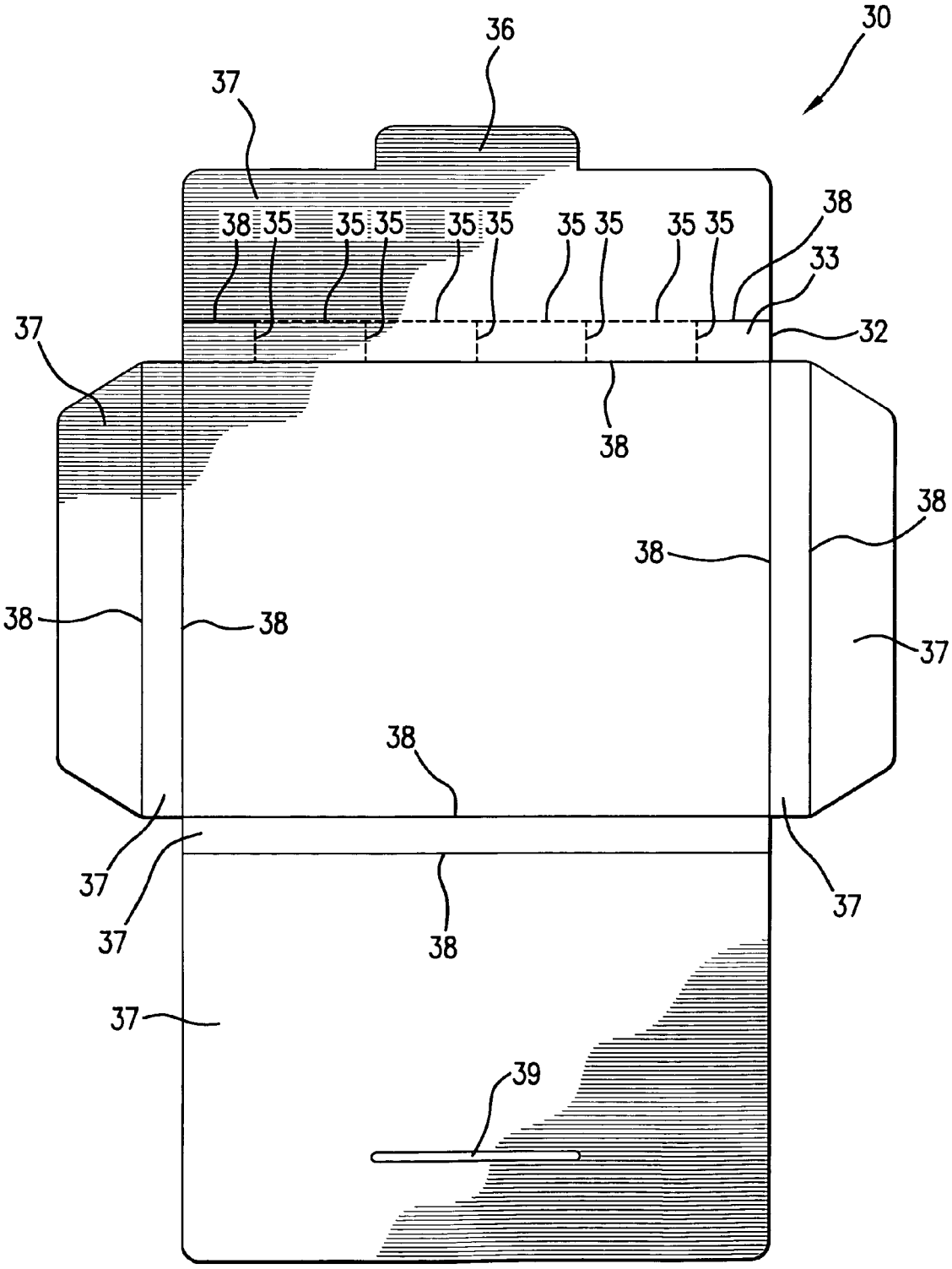
FIG. 3 is a plan view of a container in an unfolded or flat condition, according to one embodiment of this invention.

In certain embodiments of this invention, display apparatus 20 comprises container 30, such as shown in FIG. 1, for example formed by a sheet material such as shown in FIG. 3, having or comprising at least edge panel 32. In some embodiments of this invention, the sheet material comprises a plurality of panels 37, such as shown in FIG. 3. By folding panels 37 about corresponding fold lines 38, such as shown in FIG.

3, a three-dimensional container 30 can be formed or constructed by folding panels 37 as shown in FIG. 3. As shown in FIG. 3, the lowermost panel 37 has opening or slot 39 that accommodates tab 36, when container 30 is constructed.

The sheet material can have the shape shown in FIG. 3 or can have any other suitable shape that results in a desired three-dimensional shape of container 30. As shown in FIG. 1, when container 30 is in a constructed condition or an assembled condition, each side of container 30 has a generally rectangular overall shape. Depending upon the particular use of container 30, panels 37, fold lines 38 and/or the overall configuration of container 30 can have any other suitable shape.

Fold line 38 can be constructed by any suitable line of weakening known to those skilled in the art of container design. For example, fold line 38 can be constructed by bending the sheet material or by forming a perforation line or a die cut within the sheet material.

Once formed into a three-dimensional structure, container 30 can form a storage compartment or a space. In some embodiments of this invention, container 30 holds or houses a plurality of label sheets 50, such as label sheet 50 shown in FIG. 4.

In some embodiments of this invention, label sheet 50 comprises at least one identification label 45. According to certain embodiments of this invention, identifier 46 can be printed on, written on or otherwise applied to a surface of identification label 45. As shown in FIGS. 1 and 2, identification label 45 can be adhered, applied or otherwise made attachable to tab 40.

In some embodiments of this invention, identifier 46 can correspond to a particular model, size, shape and/or other design parameter of label sheet 50 or label assembly 25, such as those stored or housed within a corresponding container 30. Identifier 46 can be used to display or otherwise show, for example, which particular design or style of label sheet 50 is within the corresponding container 30. Identifier 46 can also be used to reorder label sheets 50 when container 30 is empty or nearly empty.

Edge panel 32 forms at least one releasable tab 40 that can be positioned away from outer surface 33 of edge panel 32. As shown in FIG. 3, edge panel 32 has four releasable tabs 40. Container 30 and/or edge panel 32 can have any other suitable number of tabs 40, depending upon the intended use of display apparatus 20.

FIG. 3 shows tabs 40 positioned adjacent with respect to each other. In other embodiments of this invention, two or more tabs 40 can be spaced at a distance apart from each other.

FIG. 3 shows the sheet material of container 30 having separation line 35 positioned about at least a portion of a periphery, for example three of four sides, of tab 40. When positioned adjacent to each other, two or more tabs 40 can share a border or a common separation line 35, such as shown in FIG. 3.

As used throughout this specification and in the claims, the phrases separation line, line of separation, tearable line of separation and/or tearable line are intended to be interchangable with each other and related to a line of weakening within label sheet 50, including but not limited to face sheet 26 and/or back sheet 27. The line of weakening can have a weakened structural area along which label sheet 50, face sheet 26 and/or back sheet 27 can be separated. Each separation line or tearable line of weakening, according to this invention, comprises a perforation line, a microperforation line, a die cut line, a kiss cut line, a score, a score cut line, a laser die cut line, a chemically etched line, a gas etched line and/or any other suitable line that forms a weakened structure. Any separation line according to this invention may comprise any other suitable separation line or line of weakening known to those skilled in the art of label assemblies.

Flynn et al., U.S. Pat. No. 6,837,957, and Flynn et al., U.S. Pat. No. 6,415,976, the entire teachings of both of which are incorporated into this specification by reference, teach different technical features of label sheets, label assemblies and fold lines which can be used as corresponding elements in this invention.

As shown in FIG. 1, releasable tab 40 can be positioned at an angle with respect to outer surface 33 of edge panel 32, or with respect to any other surface of container 30. Tab 40 can form the angle shown in FIGS. 1 and 2 or can form any other suitable angle, depending upon the intended use of display apparatus 20. In certain embodiments of this invention, separation line 35 borders or is routed along only a portion of a periphery of tab 40. With such configuration, tab 40 can be easily retained or attached with respect to the remaining portion of container 30. In other embodiments of this invention, the entire periphery of tab 40 can be bordered by separation line 35. With such arrangement, tab 40 can be pivoted into a display position facing either the front or the back of container 30, which can provide for a more versatile display apparatus 20.

Figure 4:
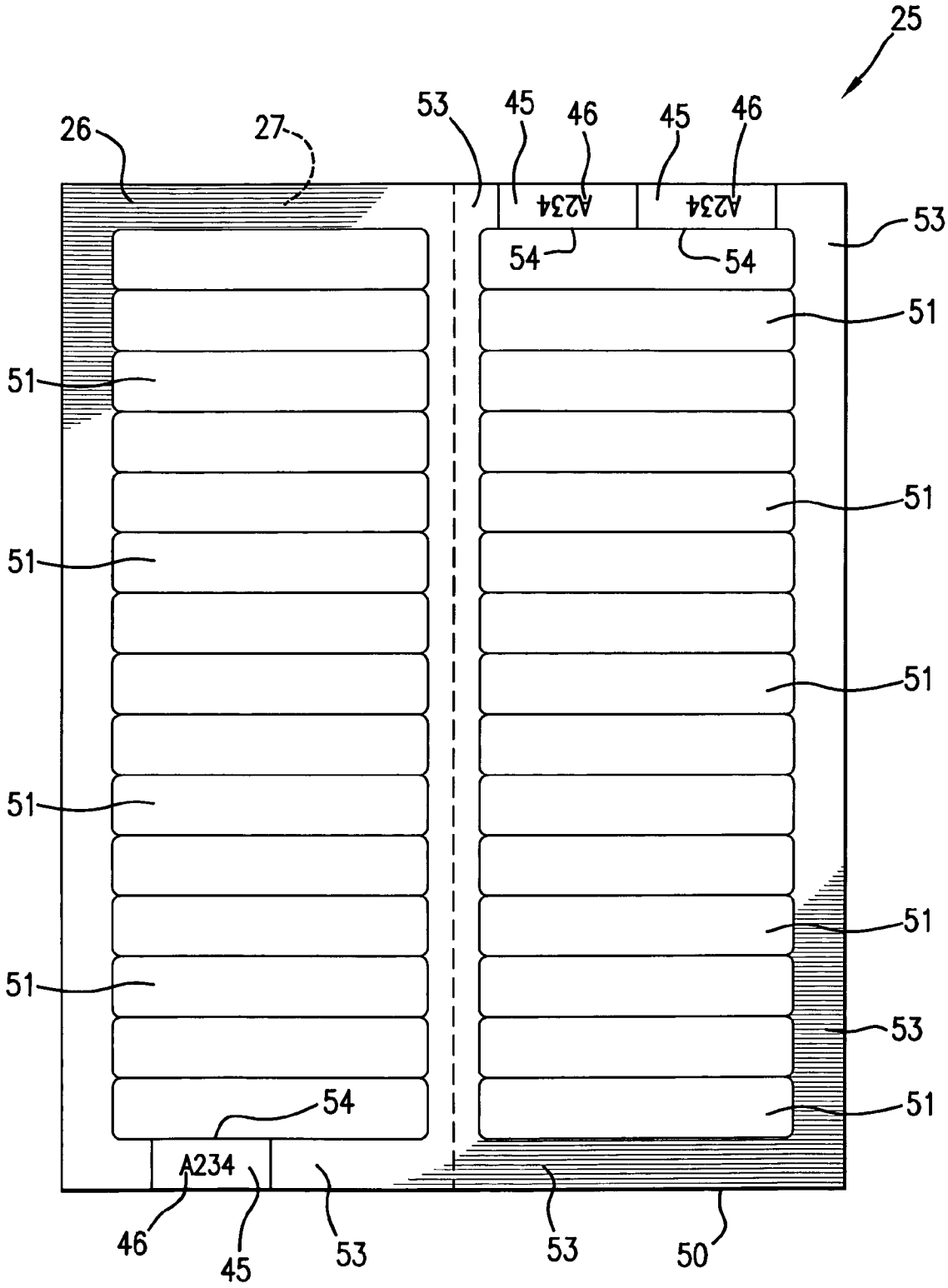
FIG. 4 is a plan view of a label assembly, according to one embodiment of this invention.

As shown in FIG. 4, identification label 45 is positioned in border area or border 53 of label sheet 50. In some embodiments of this invention, particularly where conventional printers require a border for routing label assembly 25 through a printer, border 53 contacts rollers or other mechanical equipment. Border 53 is often a non-usable print area of label sheet 50. In certain embodiments of this invention, identifier 46 can be preprinted on label sheets 50. For example, identifier 46 can be a model number that corresponds to a stock number or order number, such as those that can be used for procuring label sheet 50.

In some embodiments of this invention, a plurality of identification labels 45 are positioned in, within and/or on border 53. As shown in FIG. 4, separation line 54 is common to both printable label 51 and identification label 45. In some embodiments of this invention, for easy use, identification label 45 and printable label 51 can share a common separation line 54. For example, a die cut line can be used to easily start removal of identification label 45 from label assembly 25.

As shown in FIGS. 1-3, each tab 40 forms or has a generally rectangular shape. In other embodiments of this invention, tab 40 can have any other non-rectangular shape or any other suitable shape.

Any separation line 35 of this invention can be structured so that it is relatively easy or relatively difficult to release or fold tab 40 away from edge panel 32. For example, spaces between perforations, depth of die cuts and/or lengths of any separation line 35 can be varied to provide more or less structural support between tab 40 and the remainder of container 30.

The plan view of FIG. 4 shows face sheet 26. As indicated by the dashed element reference line in FIG. 4, back sheet 27 is on the opposite side of face sheet 26. Adhesive can be positioned between face sheet 26 and back sheet 27 so that when identification label 45 and/or printable label 51 each is removed from label assembly 25, adhesive remains on the corresponding portion of face sheet 26 but not on the corresponding portion of back sheet 27.

In some embodiments of this invention, border 53 can completely surround printable labels 51. In other embodiments of this invention, border 53 at least partially surrounds printable labels 51. FIG. 3 shows edge panel 32 positioned so that when in a constructed form, container 30 has only one edge panel 32. In other embodiments of this invention, the sheet material such as shown in FIG. 3 can have two or more edge panels 32 with releasable tabs 40, so that container 30 can be arranged in any other desired direction, orientation or position.

In other embodiments of this invention, identification label 45 can be attached to an order form or a shopping list, to communicate a need to replace or restock label sheets 50 within the corresponding container 30.

As shown in FIG. 4, identification label 45 has non-rounded corners and printable label 51 has rounded corners. In other embodiments of this invention, identification label 45 and/or printable label 51 can have any other suitable shape, size and/or design.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

What is claimed is:

1. A display apparatus for packaging a plurality of label sheets, the display apparatus comprising: a container formed by a sheet material having an edge panel with an outer surface, the edge panel forming a releasable tab foldable away from the edge panel, an identification label attachable to one of the label sheets, and an identifier on the identification label corresponding to a parameter of the label sheets, wherein the identification label has a size and shape corresponding to the releasable tab and is attachable to the releasable tab.

2. A display apparatus according to claim 1, wherein the identification label is positioned within a border area of one of the label sheets.

3. A display apparatus according to claim 2, wherein each of the identification labels shares a border with a printable label on one of the label sheets.

4. A display apparatus for a file index, the display apparatus comprising:

a container formed by a folded sheet material;

an edge panel defined between a first fold line and a second fold line each defined in the sheet material, the edge panel having an outer surface; and a releasable tab that can be positioned away from the outer surface, the releasable tab defined on a first side by a first separation line and on a second opposing side by a second separation line, each of the first separation line and the second separation line extending in the edge panel from the first fold line to the second fold line, wherein the second fold line includes a third separation line extending from the first separation line to at least the second separation line.

5. A display apparatus according to claim 4, wherein a plurality of releasable tabs are positioned along the edge panel.

6. A display apparatus according to claim 5, wherein the releasable tabs are positioned adjacent to each other.

7. A display apparatus according to claim 4, wherein in a display position the releasable tab is positioned at an angle with respect to the outer surface of the edge panel.

8. A display apparatus according to claim 4, wherein the tearable line of separation comprises the sheet material having a perforation line, a microperforation line, a die cut line, a kiss cut line, a score cut line, a laser die cut line, a chemically etched line or a gas etched line.

9. A display apparatus according to claim 4, wherein the sheet material comprises a plurality of panels, and the container is formed by folding the panels about a fold line between the panels.

10. A display apparatus according to claim 4, wherein the container forms a storage compartment.

11. A display apparatus according to claim 4, wherein the container holds a plurality of label sheets each having an identification label attachable to the releasable tab.

12. A display apparatus according to claim 11, wherein the identification label comprises an identifier that corresponds to a size of the label sheets housed within the container.

13. A display apparatus according to claim 11, wherein the identification label is positioned in a border area of one of the label sheets.

14. A display apparatus according to claim 13, wherein the border area at least partially surrounds a plurality of printable labels on one of the label sheets.

15. A display apparatus according to claim 14, wherein each of the label sheets includes a separation line common to one of the printable labels and to the identification label.

16. A display apparatus according to claim 15, wherein the identification label and one of the printable labels are positioned next to each other at the separation line.

17. A display apparatus according to claim 11, wherein each of the label sheets has a plurality of the identification labels positioned within a border area of the corresponding label sheet.

18. A display apparatus according to claim 17, wherein each of the identification labels shares a border with a printable label on one of the label sheets.

19. A display apparatus according to claim 4, wherein the releasable tab has a rectangular shape and the sheet material forms the tearable line of separation along three edges of the at least one releasable tab.

20. A display apparatus according to claim 4, further comprising a second releasable tab that can be positioned away from the outer surface, the second releasable tab defined on a first side by the second separation line and on an opposing third side by a fourth separation line, the fourth separation line extending in the edge panel from the first fold line to the second fold line, wherein the third separation line extends from the first separation line to at least the fourth separation line.

21. A display apparatus for a file index, the display apparatus comprising:

a container formed by a folded sheet material;

an edge panel defined between a first fold line and a second fold line each defined in the sheet material, the edge panel having an outer surface;

a plurality of releasable tabs each individually foldable about the first fold line away from the outer surface, each of the releasable tabs defined on opposing sides by a separation line extending from the first fold line to the second fold line, wherein each of the releasable tabs shares a common separation line with an adjacent releasable tab and the second fold line comprises a separation line extending along and defining an edge of each of the plurality of releasable tabs.

* * * * *